United States Patent [19]

Lugscheider et al.

[11] 4,414,673

[45] Nov. 8, 1983

[54] PLASMA MELTING FURNACE

[75] Inventors: Walter Lugscheider, Linz; Ernst Riegler, Enns, both of Austria

[73] Assignee: Voest-Alpine Aktiengesellschft, Linz, Austria

[21] Appl. No.: 390,331

[22] Filed: Jun. 21, 1982

[30] Foreign Application Priority Data

Jul. 15, 1981 [AT] Austria ..... 3116/81

[51] Int. Cl.[3] ..... H05B 7/00

[52] U.S. Cl. ..... 373/22; 373/81

[58] Field of Search ..... 373/18, 22, 24, 81

[56] References Cited

U.S. PATENT DOCUMENTS

| | | | |
|---|---|---|---|
| 3,472,649 | 10/1969 | Sibakin et al. | 373/81 |
| 3,666,871 | 5/1972 | Thom | 373/81 |
| 4,048,436 | 9/1977 | Hiratake et al. | 373/22 |
| 4,079,185 | 3/1978 | Collin | 373/81 |
| 4,160,867 | 7/1979 | Fey | 373/22 |

*Primary Examiner*—Roy N. Envall, Jr.

*Attorney, Agent, or Firm*—Brumbaugh, Graves, Donohue & Raymond

[57] ABSTRACT

A plasma melting furnace includes a furnace body, a covering cap, one or more electrodes penetrating the bottom of the furnace body, and at least three plasma burners penetrating the furnace wall or the covering cap and arranged so as to be inclined towards the bottom. In order to achieve a high melting performance with a simultaneously low energy consumption, charging openings are provided in the covering cap for the continuous melting of small-sized material, such as light scrap and iron sponge. Their vertical axes are located in a plane extending through the angular symmetry of the normal projection of the axes of two neighboring plasma burners as well as between two vertical planes each extending perpendicular to the normal projections of the individual burner axes. One of the two planes is laid through the point of impact of the direct plasma jets on the melt and the second plane extends parallel thereto at the distance of a third of the length of the projections of the direct plasma jets from their exit out of the burners as far as to their point of impact.

6 Claims, 2 Drawing Figures

PLASMA MELTING FURNACE

The invention relates to a plasma melting furnace comprising a furnace body, a covering cap, one or more electrodes penetrating the bottom of the furnace body, and at least three plasma burners penetrating the furnace wall or the covering cap and arranged so as to be inclined towards the bottom.

Plasma melting furnaces of this kind are known, for instance from U.S. Pat. No. 3,422,206, in which a melting furnace is described where the plasma burners are arranged in the substantially cylindrical furnace wall. The direct arc plasma formed after applying voltage, as a linear radiator, does not radiate in the axial direction of the burner. The material charged in batches from above deposits as a conical pile in the furnace; it must not come to lie above the burners, since this will lead to short circuits. The heat transmission from the arc plasmas onto the melting stock is effected from above. The melting performance of such furnaces is low due to the poor heat transmission in this direction.

Furthermore, plasma burners with an annular cathode for producing a rotating electric arc are known from U.S. Pat. No. 4,275,287, wherein slat forming means, e.g., can be conveyed by means of an inert gas through a central opening of a burner led through the furnace ceiling. This has the disadvantage that the arc plasma is disturbed by the addition of solid particles.

With the known plasma melting furnaces it is not possible to melt continuously and with a high efficiency small-sized iron sponge, light scrap and similar materials, i.e. to achieve a high melting performance with a simultaneously low energy consumption. Compared to compact iron, iron sponge is a poor thermal conductor and to be regarded almost as an insulator; it is hard to melt in a bath of molten metal, sometimes even being covered by slag and overheated so that explosion-like retardations of boiling may occur.

SUMMARY OF THE INVENTION

The invention has as its object to eliminate the disadvantages and difficulties described and has as its object to provide a plasma melting furnace into which small-sized iron sponge, light scrap and similar metallic or non-metallic materials can be continuously charged, with the heat transmission to the melting stock and thus the efficiency being improved at the same time.

The set object is achieved with a plasma melting furnace of the initially defined kind in that charging openings are provided in the covering cap for the continuous melting of small-sized material, such as light scrap and iron sponge, whose vertical axes are located in a plane extending through the angular symmetry of the normal projection of the axes of two neighboring plasma burners as well as between two vertical planes each extending perpendicular to the normal projections of the individual burner axes, one of the two planes being laid through the point of impact of the direct plasma jets on the melt and the second plane extending parallel thereto at the distance of a third of the length of the projections of the direct plasma jets from their exit out of the burners as far as to their point of impact.

The substantially spherical iron sponge particles and the small-sized materials are supplied to the metal bath through the charging openings positioned in accordance with the invention in a manner that their surfaces are subjected to the heat radiation of the direct arc plasma of two neighboring burners during the free fall. During the falling time through these zones in which the radiation fields of two neighboring plasma burners intersect, preheating of the solid materials takes place and even their partial liquefaction. At the high temperatures of the direct arc plasmas of about 20,000 K the heat transmission to all freely falling particles is very intensive; this kind of heat transfer is particularly effective when melting iron sponge, an iron carrier of a high porosity.

The covering cap suitably is semispherically designed, a good reflection and concentration of the heat radiation onto the metal bath thus being provided. Furthermore, the consumption of bricks for the lining is reduced.

DESCRIPTION OF EXEMPLARY EMBODIMENT

Advantageously, the covering cap is designed in two parts, the upper part being detachably connected with the lower part and the plasma burners being guided through the lower part of the covering cap.

The charging openings, with such a design of the plasma melting furnace, preferably are provided in the upper part.

According to an advantageous embodiment of the invention the upper part comprises an opening and a connection piece for the discharge of furnace gases.

Furthermore, it is particularly suitable with a plasma melting furnace according to the invention if supply tubes are arranged above the charging openings, which tubes can be charged with small-sized material by a vibration conveying means and whose axes are in alignment with the vertical axes of the charging openings.

BRIEF DESCRIPTION OF THE DRAWING

The invention will now be explained in more detail by way of one embodiment and with reference to the accompanying drawing, wherein.

Figure 1:
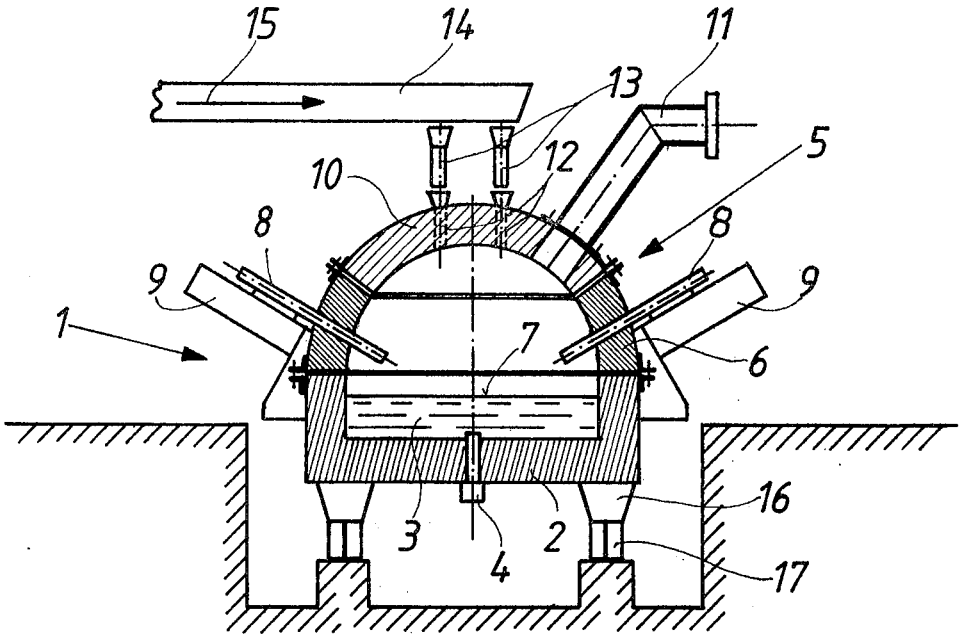
FIG. 1 is a vertical section through a plasma melting furnace according to the invention.

A plasma melting furnace is generally denoted by 1 in FIG. 1. It comprises a furnace body 2 for accommodating melt 3. Through the bottom of the furnace body 2 an electrode 4 projects into the melt 3. The covering cap 5 of the furnace is of a substantially spherical shape. In the embodiment illustrated, the covering cap 5 is assembled of two parts, a lower part 6 detachably fastened on the furnace body 2 and including at least three plasma burners 8, four being shown in the illustrated embodiment, the burners being inclined at an acute angle to the bottom of the furnace body and the bath surface 7 and mounted on a supporting structure 9 so as to be axially displaceable, and an upper part 10 detachably connected with the lower part 6 of the cap 5 and liftable by a lifting and pivoting means (not illustrated) as in use with plasma and electric arc furnaces.

After charging the plasma burners 8 are ignited and the material charged is being melted. After the formation of a sufficiently large sump of molten metal, it is started to continuously supply small-sized iron sponge and/or light scrap. The furnace gases forming during the melting process are discharged through an opening provided in the upper part 10 and through a connection piece 11. The connection piece 11 may be connected with an exhaust pipe.

The charging openings 12 either are refractorily lined, the lining advantageously being funnel-likely widened on the outer side of the furnace, or they are penetrated by water-cooled jacket tubes of corresponding diameters, which tubes suitably also have a funnel-shaped enlargement. In the embodiment illustrated four charging openings 12 are provided in the upper part 10. They correspond to supply tubes 13, which, in turn, are located below openings (not illustrated) of a vibration conveying chute 14. The material to be melted is conveyed through this chute, the conveying direction being indicated by the arrow 15. The plasma melting furnace, in a manner known per se, is tiltably mounted on movable beams 16 and pertaining runways 17; it furthermore comprises an opening (not illustrated) for the teeming of melt and, if necessary, of slag.

Figure 2:
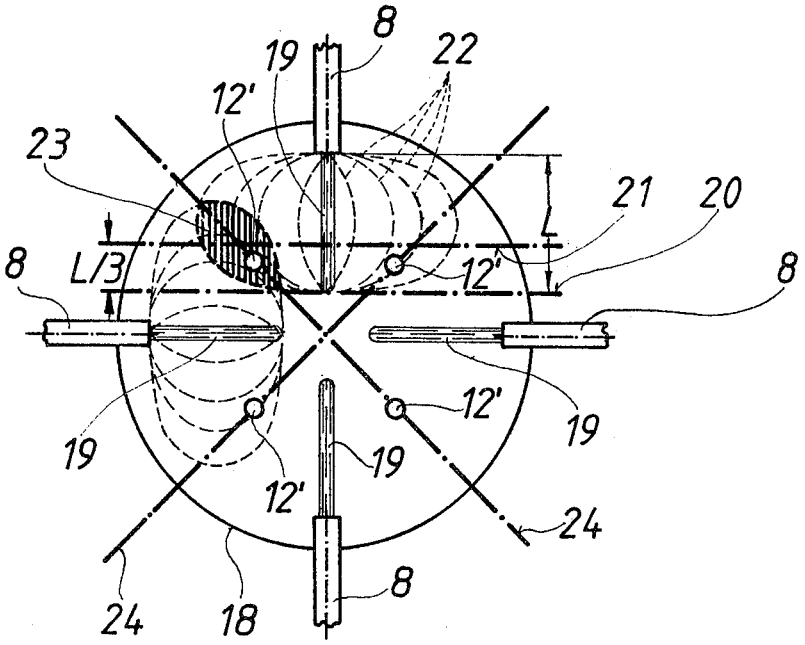
FIG. 2 is an enlarged schematic horizontal section through the plasma melting furnace in the region of the melt surface, various structural details having been omitted; the heat radiation fields of two neighboring direct arc plasmas from four plasma burners and the positions of four charging openings are illustrated.

In FIG. 2 the internal limitation of the cylindrical furnace body 2 of the plasma melting furnace 1 is denoted by 18. The direct arc plasmas (plasma jets) 19 come from the four plasma burners 8 arranged symmetrical relative to the perpendicular axis of the plasma melting furnace. Through the point of impact of one of the direct plasma jets on the melt a dot-and-dash line 20 is drawn perpendicular to the projection of the plasma jet. To the projection of the plasma jet 19 from its exit out of the burner 8 as far as to its point of impact a length L is allocated. A second line 21 is plotted parallel to line 20 at a distance L/3. The lines 20 and 21 mark the traces of two vertical planes.

The point of impact mentioned can easily be determined in an optical way. For two of the total of four direct arc plasmas 19 the field lines 22 of the heat radiation are entered in broken lines, illustrating the propagation directions of the heat radiation. As can be seen, there is a zone 23 in which the radiation fields of the plasma jets of two neighboring burners 8 intersect. This zone is marked by hatching. The region chosen in accordance with the invention for arranging the vertical axes of the charging openings lies in a plane that extends through the angular symmetry 24 of the normal projection of the axes of two neighboring plasma burners 8 and between the two vertical planes through the lines 20 and 21. The material falling through the charging openings directly reaches zones of a concentrated heat radiation, one of which is designed by 23. Favorable positions of charging openings leading through the covering cap 5 or the upper part 10 of a plasma melting furnace of the invention are indicated by 12'.

The direct arc plasmas are not disturbed by the materials supplied. A continuous operation with any embodiments of burners is possible with a plasma melting furnace according to the invention. It goes without saying that also alloying elements and/or slag formers, such as lime and fluorspar, can be charged through the charging openings 12 continuously or discontinuously; the number of burners is variable, depending on the type of material to be melted and the capacity of the plasma melting furnace.

What we claim is:

1. In a plasma melting furnace of the type including a furnace body defined by a bottom and a furnace wall and accommodating a melt, a covering cap, at least one electrode penetrating said bottom of said furnace body, and at least three plasma burners penetrating said furnace wall or said covering cap and arranged so as to be inclined towards said bottom, said at least three plasma burners being adapted to emit direct plasma jets onto said melt, the improvement comprising charging openings having vertical axes and being provided in said covering cap for continuously melting small-sized material, such as light scrap and iron sponge, and wherein a plane is laid through the angular symmetry of the normal projections of the axes of two neighboring plasma burners, and two vertical planes each extend perpendicular to the normal projections of the axes of each of said at least three plasma burners, the first of said two vertical planes being laid through the impact points of said direct plasma jets on the melt and the second of said two vertical planes extending parallel to the first one at a distance of a third of the projection length of said direct plasma jets from their exit out of said plasma burners as far as to their impact points, said vertical axes of said charging openings extending in said plane laid through the angular symmetry of the normal projections of the axes of two neighboring plasma burners and between said two vertical planes.

2. A plasma melting furnace as set forth in claim 1, wherein said covering cap substantially is semispherically designed.

3. A plasma melting furnace as set forth in claim 1, wherein said covering cap is designed in two parts comprising an upper part and a lower part, said upper part being detachably connected with said lower part.

4. A plasma melting furnace as set forth in claim 3, wherein said charging openings are provided in said upper part.

5. A plasma melting furnace as set forth in claim 3, further comprising an opening and a connection piece provided in said upper part for discharging furnace gases.

6. A plasma melting furnace as set forth in claim 1, 2, 3, 4 or 5, further comprising supply tubes arranged above said charging openings in a manner that their axes are in alignment withthe vertical axes of said charging openings, and a vibration conveying means provided for supplying small-sized material to said supply tubes.

* * * * *

UNITED STATES PATENT AND TRADEMARK OFFICE

CERTIFICATE OF CORRECTION

PATENT NO. : 4,414,673

DATED : Nov. 8, 1983

INVENTOR(S) : Lugscheider et al.

It is certified that error appears in the above—identified patent and that said Letters Patent is hereby corrected as shown below:

First page, Item 56, add the following to the list of U. S. PATENT DOCUMENTS:

--3,422,206 1/1969 Baker et al.
4,275,287 6/1981 Hiratake-- and insert thereafter:

--FOREIGN PATENT DOCUMENTS 59,927 7/1913 Austria--.

Col. 1, above line 4, insert the heading --BACKGROUND OF THE INVENTION--.

Col. 2, lines 66-67, change "it is started to continuously supply" to --a continuous supply of--;

line 68, after "scrap" insert --is started--.

Col. 3, lines 5-6, change "refractorily lined" to --lined with a refractory material--;

UNITED STATES PATENT AND TRADEMARK OFFICE

CERTIFICATE OF CORRECTION

PATENT NO. : 4,414,673

DATED : Nov. 8, 1983

INVENTOR(S) : Lugscheider et al.

It is certified that error appears in the above—identified patent and that said Letters Patent is hereby corrected as shown below:

Col. 3, line 6, delete "funnel-likely";

line 7, after "widened" insert --in a funnel-like manner--;

lines 24-25, "symmetrical" should read --symmetrically--

Col. 4, line 53, "withthe" should read --with the--.

Signed and Sealed this

*Seventeenth* Day of *July 1984*

[SEAL]

*Attest:*

GERALD J. MOSSINGHOFF

*Attesting Officer*

*Commissioner of Patents and Trademarks*